US005622330A

United States Patent [19]

Sharp et al.

[11] Patent Number: 5,622,330

[45] Date of Patent: Apr. 22, 1997

[54] SELF-ADJUSTING FEED STOCK ACCUMULATOR SYSTEM

[75] Inventors: Roger F. Sharp, Otis Orchard; Terry M. Frost, Spokane; Don W. Graham, Green Acres, all of Wash.

[73] Assignee: ASC Machine Tools, Inc., Spokane, Wash.

[21] Appl. No.: 517,173

[22] Filed: Aug. 21, 1995

Related U.S. Application Data

[63] Continuation-in-part of Ser. No. 239,603, May 9, 1994, abandoned, and a continuation-in-part of Ser. No. 74,958, Jun. 10, 1993, abandoned.

[51] Int. Cl.[6] ..... B65H 23/192

[52] U.S. Cl. ..... 242/418.1; 226/42

[58] Field of Search ..... 242/418.1, 420.6; 226/42, 43, 44; 318/6; 221/9

[56] References Cited

U.S. PATENT DOCUMENTS

| | | | |
|---|---|---|---|
| 3,177,749 | 4/1965 | Best et al. | 83/208 |
| 3,807,612 | 4/1974 | Eggert | 226/42 |
| 3,810,591 | 5/1974 | Haven . | |
| 3,817,067 | 6/1974 | Voorhes et al. | 72/12 |
| 4,058,270 | 11/1977 | Simmons et al. . | |
| 4,249,705 | 2/1981 | Brooks et al. . | |
| 4,290,563 | 9/1981 | Brooks et al. . | |
| 4,561,581 | 12/1985 | Kelly | 226/113 |
| 4,582,271 | 4/1986 | Takahashi . | |
| 4,610,408 | 9/1986 | Box et al. . | |
| 4,804,898 | 2/1989 | Nordlof et al. | 318/569 |

*Primary Examiner*—John M. Jillions

*Attorney, Agent, or Firm*—Bill D. McCarthy; Phillip L. Free, Jr.; Randall K. McCarthy

[57] ABSTRACT

A system for controlling the feed rate of a feed stock to processing equipment by monitoring and controlling the length of the feed stock in an accumulator assembly. The control system regulates the feed rate of the feed stock by initially forming a line of the feed stock in the accumulator assembly, detecting the extent of the length of the line with respect to preselected set points, controlling the length of the line in the accumulator assembly by adjusting the feed rate of the feed stock from a base feed rate in response to preselected minimum and maximum values for the length of the feed stock line, and adjusting the base feed rate with each excursion of the line from the preselected minimum and maximums.

8 Claims, 6 Drawing Sheets

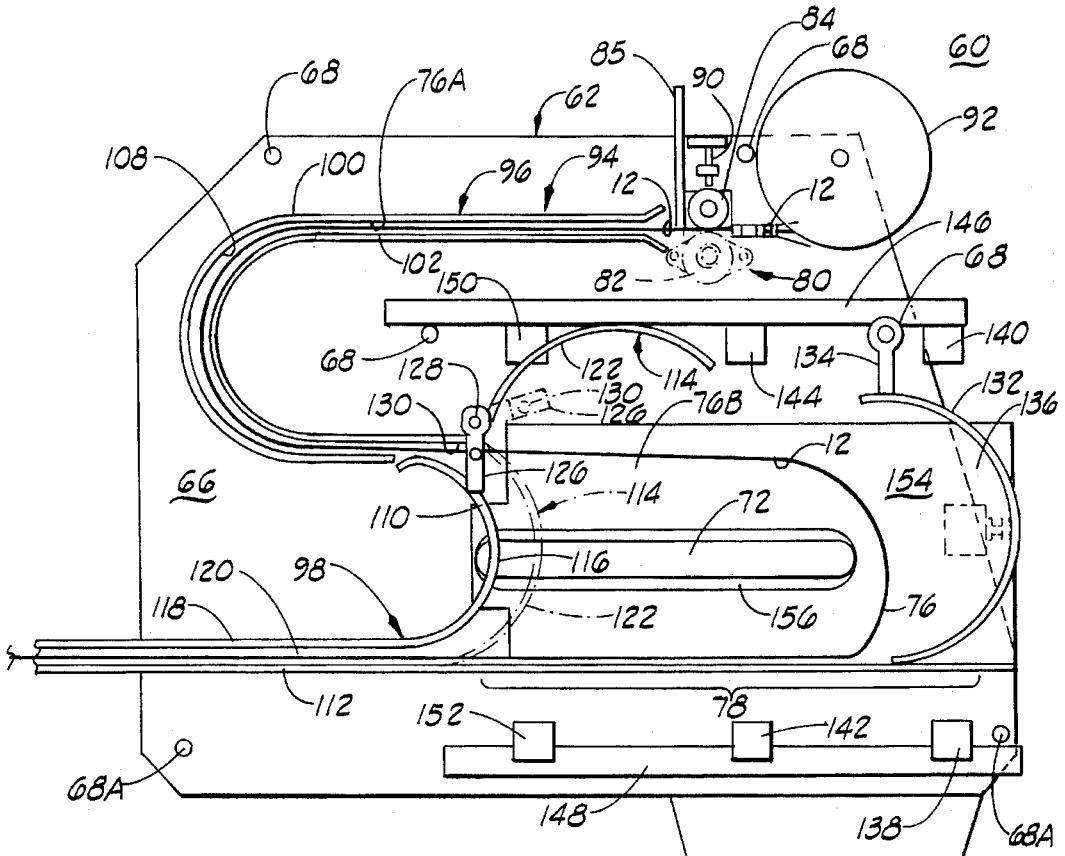
FIG. 3
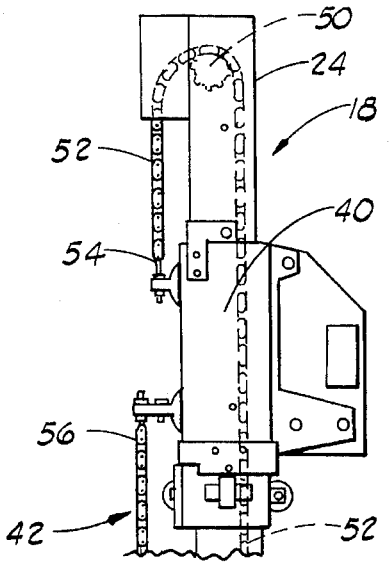
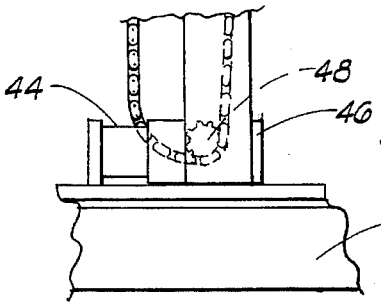
FIG. 2

SELF-ADJUSTING FEED STOCK ACCUMULATOR SYSTEM

The present application is a continuation application to U.S. patent application Ser. No. 08/239,603 entitled FEED STOCK ACCUMULATOR SYSTEM, filed May 9, 1994, abandoned and to U.S. patent application Ser. No. 08/074,958 entitled STRIP MATERIAL ACCUMULATOR CONTROL SYSTEM (As Amended), filed Jun. 10, 1993, abandoned.

BACKGROUND OF THE INVENTION

1. Field of the Invention

The present invention relates to material dispensing equipment, and more particularly, but not by way of limitation, to a control system for providing a steady state supply of a feed stock material to processing equipment.

2. Brief Description of the Prior Art

In processing equipment that performs a unit operation such as that of a punch press or a beverage dispenser requiring material or articles (such as beverage lids or the like fed as a line) to be fed to the equipment, it is desirable that the feed stock be available upon demand so that there are no disruptions of the feed stock. That is, the processing equipment's feed stock should be unrestricted, and to this end, various inventory control mechanisms are available to assure a continuing and constant feed rate of feed stock to such processing equipment. This becomes increasingly more important and demanding of the inventory control mechanism when the processing equipment must adjust to varying rams of feed stock demands.

For example, materials such as steel and aluminum are often most efficiently processed to punch presses and the like in the form of long, continuous webs or strips. Such material is often supplied in the form of coils, and an uncoiling apparatus is used to draw material from the coil for feeding it to the downstream processing equipment. Similarly, a feed stock of incremental articles, such as beverage container lids, is often fed to processing equipment as a continuous line of such articles, often passing like a flexible continuum through twists and turns. A feed stock accumulator is commonly positioned between the coil assembly and the processing equipment to store a sufficient amount of material so that a steady-state flow of material is available to the processing equipment.

Accumulators used with uncoilers are often designed to form a slack loop of material which serves to provide a readily available, tension free supply of the material for the processing equipment. Accumulators of many such designs have been used successfully for many years. Illustrative of such accumulators are: U.S. Pat. Nos. 3,177,749 issued to Best et al.; 4,770,366 issued to Hood et al; 3,888,400 issued Wiig; 4,489,872 issued to Bolton et al. For example, both U.S. Pat. Nos. 3,888,400 to Wiig and 4,489,872 to Bolton teach an accumulator in which a loop of feed stock is detected by optical sensors which detect the presence or absence of the loop as material is fed to the loop from a coil assembly or the like and as material is withdrawn from the loop by the processing equipment. In each case the material feed rate is increased if the loop is shortened beyond a predetermined limit and the material feed rate is decreased if the loop is increased beyond a predetermined limit. However, none of the known prior art is helpful in maintaining the loop within the confinements of preset minimum and maximum excursions of the loop for widely variable demands by the processing equipment.

There is a need for an inventory control system that permits the storage of a sufficient quantity of material for the steady state feeding of material to processing equipment so that continuous feed stock is available during varying feed demand, while at the same time preferably functioning in a non-contact manner. Such a control system would include a control system which is able to teach itself to deal with feed stock loop excursions as operating conditions are experienced.

SUMMARY OF THE INVENTION

The present invention provides a system for controlling the feed rate of a feed stock from a feeder source of such material and for supplying such feed stock to processing equipment which is downstream thereto. Broadly, the present invention relates to a control system for regulating the feed rate of a loop or a line of material from a feeder source to downstream processing equipment by monitoring and controlling feed stock in an accumulator assembly.

In an exemplary embodiment, the control system of the present invention regulates the feed rate of material from a coil assembly to downstream processing equipment by initially forming a line of material in the accumulator assembly positioned between the feed stock source and the processing equipment, Thereafter, the extent of the line with respect to preselected set points is detected to determine whether the length of the line is less than a preselected minimum length, greater than a preselected maximum length or between the preselected minimum and maximum lengths. If the length of the material line is less than the preselected minimum, the material is fed from the coil stock into the accumulator assembly at a rate greater than the rate at which the material is drawn into the downstream processing equipment. On the other hand, if the length of the material line in the accumulator assembly is greater than the preselected maximum, the material is fed from the coil stock into the accumulator assembly at a rate less than the rate at which the material is drawn into the downstream processing equipment. When the length of the material line is detected to be between the preselected minimum and maximum lengths, the material is fed into the accumulator assembly at a base, or set, feed rate.

To compensate for changes in the length of the line of material, the base feed rate is adjusted to a lower value each time the length of the material line makes an excursion from between the preselected minimum and the maximum lengths to a length greater than the preselected maximum length; and the base feed rate is adjusted to a higher value each time the length of the material line makes an excursion from between the preselected minimum and maximum lengths to a length less than the preselected minimum.

An object of the present invention is to provide an inventory control system for regulating the feed rate of feed stock from a feeder source to processing equipment into which the feed stock is drawn at a rate determined by such processing equipment.

Another object of the present invention, while achieving the above-stated object, is to provide a self adjusting inventory control system capable of providing a steady state supply of the feed stock from the feeder source to the downstream processing equipment.

Another object of the present invention, while achieving the above-stated objects, is to provide a self adjusting inventory control system capable of providing a steady state supply of the feed stock, for a wide range of materials and continuously alignable discrete articles, from the feeder source to the downstream processing equipment.

Still another object of the present invention, while achieving the above-stated objects, is to provide a self adjusting inventory control system which is inexpensive to manufacture, operate and maintain.

Other objects, advantages and features of the present invention will become apparent upon reading of the following detailed description in conjunction with the appended claims.

BRIEF DESCRIPTION OF THE DRAWINGS

FIG. 2 is a fragmental, side elevational view of a mast and boom assembly of the vertical uncoiling assembly of FIG. 1.

FIG. 4 is a top plan view of the feed stock accumulator assembly of FIG. 1.

FIG. 6 is a flow chart of the control program carried out by the microprocessor of the control circuit of FIG. 5.

DETAILED DESCRIPTION

The present invention will be described in detail for an exemplary embodiment of the invention which involves a self adjusting control system used to provide a steady state supply of tension-free material from a coil of strip material. It will be appreciated that the present invention is not limited to an industrial application involving strip material; indeed, the present invention will find application wherever there is a need for an inventory control system in which it is desired to have no physical contact with the inventoried material. In the example which follows, strip material of a thin foil or strip material which cannot be allowed to incur surface abrasions is shown in the accompanying drawings and discussed herein. Another example would be where the material being fed to downstream processing equipment consists of discrete articles, such as beverage containers or the like, which are fed to the processing equipment as a line of such containers.

Figure 1:
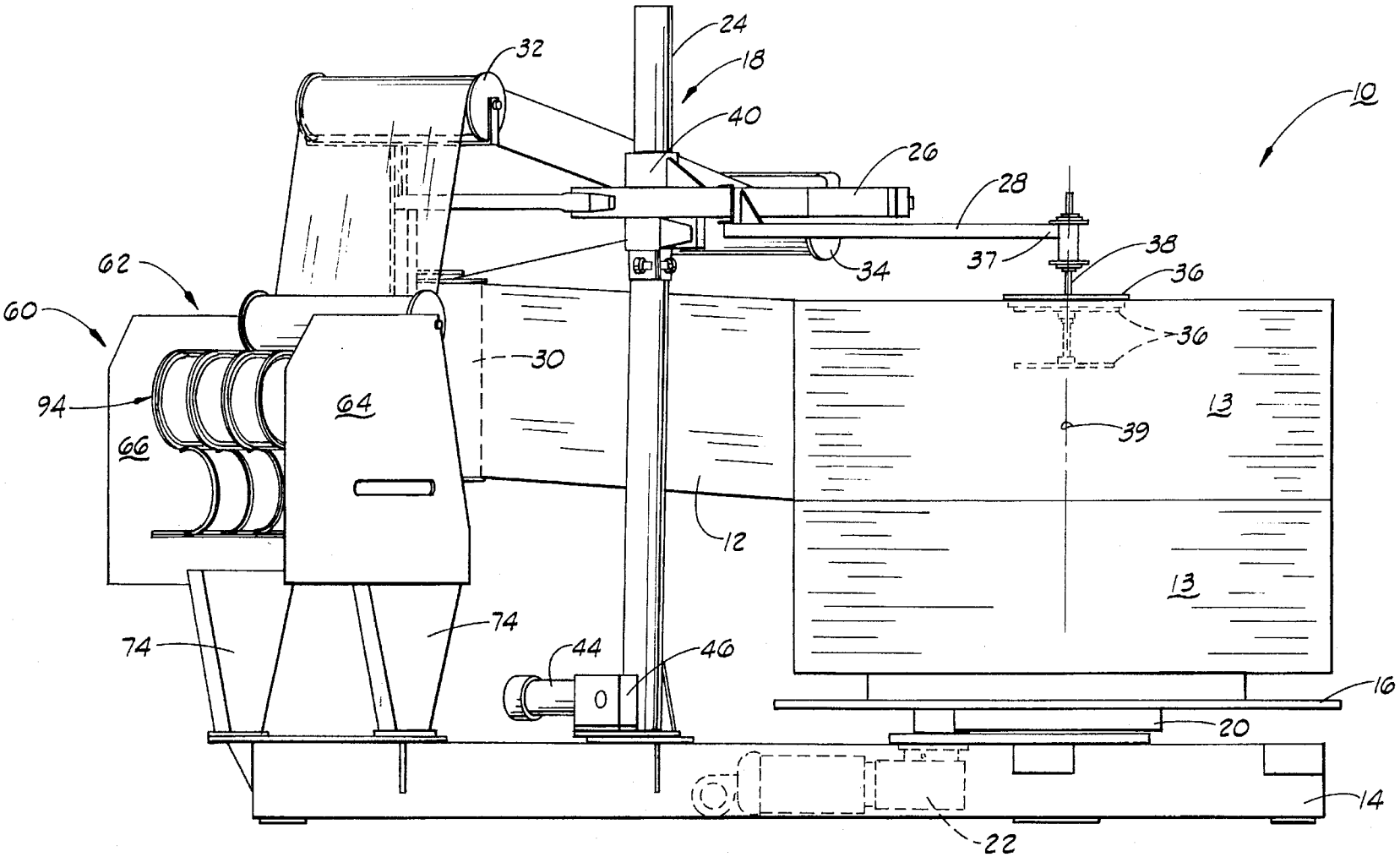
FIG. 1 is a perspective view of an exemplary embodiment of the present invention as a vertical uncoiling assembly employing a feed stock accumulator assembly having an inventory control system constructed in accordance with the present invention.

Referring now to the drawings, and more particularly to FIG. 1, illustrated therein is an uncoiling assembly 10 for feeding a material 12, such as a narrow, long strip of thin metal which has been coiled. The material 12 is being passed to processing equipment (not shown), such as a punch press or the like. The uncoiling assembly 10 is adapted to hold the material 12 in a plurality of vertically disposed coils 13 with the trailing end of the material 12 on an upper disposed coil 13 attached to the leading end of the material 12 on an adjacently disposed lower coil 13.

The uncoiling assembly 10 includes a base frame 14 on which a turntable 16 and a mast and boom assembly 18 are supported. The turntable 16 is connected to a gear 20 which is driven by a variable speed brake motor 22. The mast and boom assembly 18 includes a mast 24, a first boom arm 26 and a second boom arm 28. As will be described in more detail hereinafter, the first boom arm 26 is slidably supported by the mast 24; and the second boom arm 28 is connected to the first boom arm 26.

A series of spools or idler rollers and centering discs are attached to the first and second boom arms 26, 28. More specifically, a vertical idler roller 30 and a first horizontal idler roller 32 are attached at one end of the first boom arm 26, and a second horizontal idler roller 34 is attached at the other end of the first boom arm 26. A plurality of centering discs 36 are rotatably connected to a distal end 37 of the second boom arm 28 via a journaled shaft 38; and the second boom arm 28 is connected to the first boom arm 26 such that the centering discs 36 are aligned with a vertical axis of rotation 39 of the turntable 16 and extend into the uppermost disposed coil 13 of the material 12.

The first boom arm 26 is slidably connected to the mast 24 by a boom collar 40 so that the height of the first boom arm 26, and thus the height of the vertical idler roller 30, the first and second horizontal idler rollers 32, 34 and the second boom arm 28 can be vertically adjusted. The boom collar 40 is vertically movable along the mast 24 by a chain and sprocket assembly 42 as shown in FIG. 2. The chain and sprocket assembly 42 comprises a motor 44, a gearbox 46 having a driver sprocket 48 connected to an output shaft (not shown), a driven sprocket 50 journally connected to the mast 24, and a chain member 52 having a first end 54 and a second end 56. The first and second ends 54, 56 of the chain member 52 are connected to the boom collar 40 so that the chain member 52 extends around the driver sprocket 48 and the driven sprocket 50. Thus, upon activation of the motor 44, the boom collar 40 can be selectively moved along the mast 24 to raise the centering discs 36 during the loading of the coils 13 on the turntable 16; or, the boom collar 40 can be selectively moved along the mast 24 to lower the centering discs 36 into the uppermost coil for paying out the material 12 from the coil 13.

To operate the uncoiling assembly 10, the coils 13 are placed on the turntable 16 in an "eye to the sky" or vertical axial position and the first boom arm 26 is vertically positioned so that the centering discs 36 supported on the distal end 37 of the second boom arm 28 are disposed within the center of the upper coil 13. The material 12 is then threaded from the coil 13 over the vertical idler roller 30 and the first and second horizontal idler rollers 32, 34, substantially as shown in FIG. 1.

The uncoiling assembly 10 further includes an accumulator assembly 60 for providing downstream processing equipment with a steady-state flow of the material 12 in a non-contact, tension-free manner. As more clearly shown in FIGS. 3 and 4, the accumulator assembly 60 is provided with a frame 62 having a pair of spatially disposed side plates 64, 66. The side plates 64, 66 are rigidly interconnected in a parallel relationship by a plurality of rigid cross members 68, 68A which transversely extend between the side plates 64, 66. The side plates 64, 66 are secured to the ends of the cross members 68, 68A in a suitable manner, such as with bolts 70, 70A which extend through holes (not shown) in the side plates 64, 66 and threadingly engage the ends of the cross members 68, 68A, respectively. Each of the side plates 64, 66 is provided with a viewing slot, such as viewing slot 72 in the side plate 66 (FIG. 3), to enable an operator to view the material 12 as it travels through the accumulator assembly 60.

The frame 62 is elevated from the floor by a pair of support legs 74 so that, as the material 12 travels through the accumulator assembly 60, the material 12 is in substantial alignment with the downstream processing equipment (not shown). The support legs 74 are rigidly connected to the side plates 64, 66 of the frame 62 and to the base frame 14 of the uncoiling assembly 10, substantially as shown in FIG. 1. It should be understood that the support legs 74 can be secured to a separate base member so that the accumulator assembly 60 can be provided as a separate unit from the uncoiling assembly 10.

Figure 3:
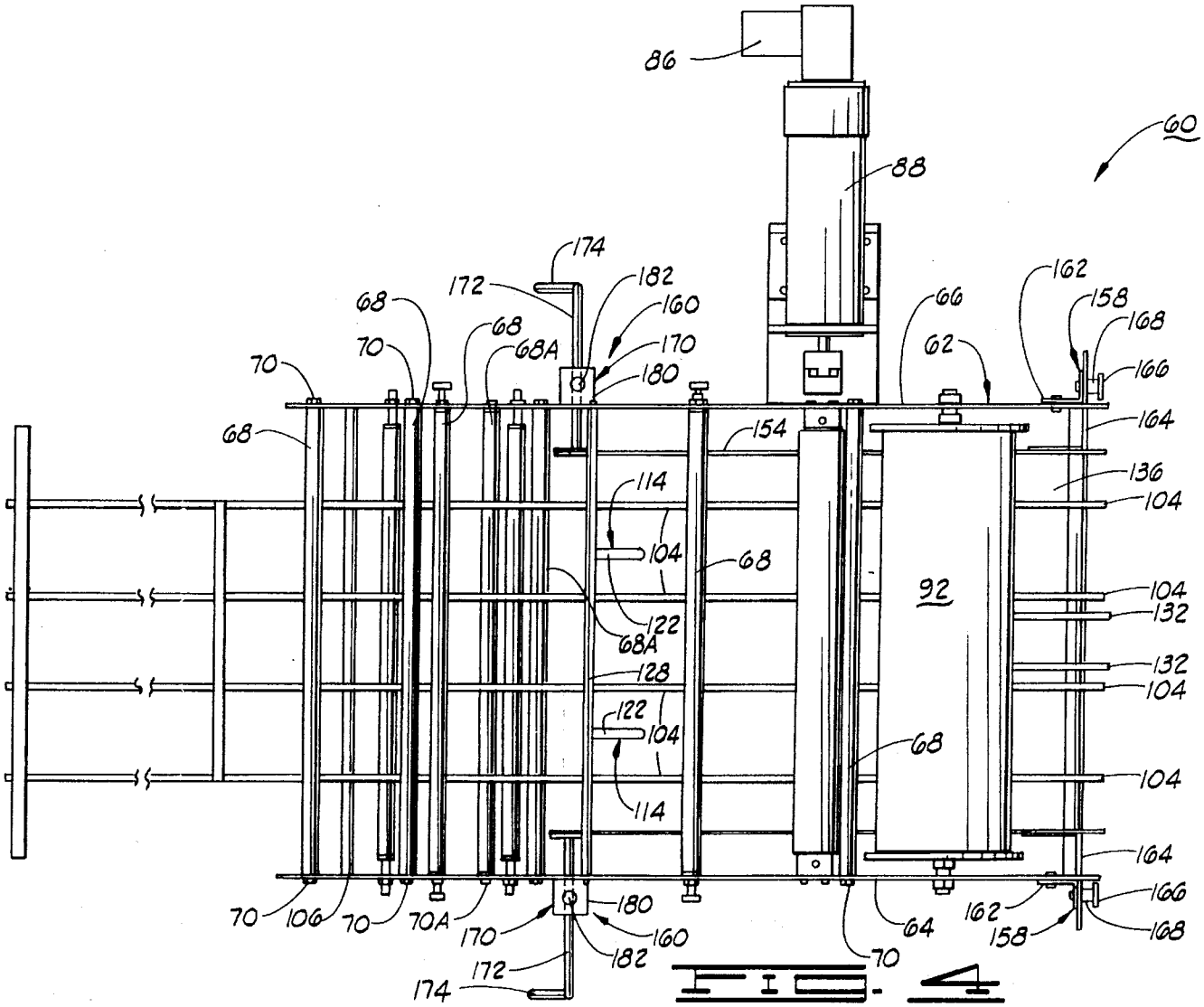
FIG. 3 is a side elevational view of the feed stock accumulator assembly of FIG. 1 having a side plate removed therefrom for the sake of clarity.

The material 12 travels through the accumulator assembly 60 in a substantially S-shaped line or loop 76 that includes an upper loop portion 76A and a lower loop portion 76B. The material 12 traveling through the lower loop portion 76B passes through an accumulator loop area 78 (also sometimes referred to hereinafter as an accumulator line area) of the accumulator assembly 60 wherein the material 12 is substantially unconfined (FIG. 3). Thus, the lower loop portion 76B functions as an accumulator loop which permits the material 12 to fluctuate back and forth in a tension-free manner along the accumulator loop area 78 in response to changes in the material demand of the processing equipment. The changes in the size of the accumulator loop of the material 12 is used to control the pay out rate of the uncoiling assembly 10, as will be described hereinafter. It will be understood by persons skilled in the art who will recognize that the continuous loop 76 is possible with the continuous strip material 12; for the case of discrete articles, an equivalent to the loop 76 can be achieved either by a vertically extending line or a horizontal extending loop similar to that shown herein, depending upon the character of articles processed.

The material 12 is fed into the accumulator assembly 60 by a feed or pinch roller assembly 80. The feed assembly 80 includes a lower roller 82 and an upper roller 84, each of which is pivotally supported between the side plates 64, 66. The upper roller 84 is connected to a hand lever 85 so that during start-up the upper roller 84 can be raised relative to the lower roller 82 to enhance feeding of the material 12 through the feed roller assembly 80.

The lower roller 82 is operably connected to a variable speed motor 86 through a gear box 88 (FIG. 4); and the upper roller 84 is spring biased to produce a gripping force between the lower and upper rollers 82, 84. The gripping force between the lower and upper rollers 82, 84 can be adjusted by rotation of a threaded collar 90. As will be described hereinafter, the speed of the lower roller 82 is controlled so as to be responsive to the material requirements of the processing equipment.

The material 12 is fed to the lower and upper rollers 82, 84 of the pinch roller assembly 80 from an idler roller 92 pivotally mounted between the side plates 64 and 66. The idler roller 92 is positioned so that the material 12 is aligned with the slot formed between the lower and upper rollers 82, 84 when the material 12 comes off the idler roller 92. The material 12 is received by the idler roller 92 from the first horizontal idler roller 32, as shown in FIG. 1.

The material 12 travels through the accumulator assembly 60 along a substantially S-shaped travel path defined by a guide assembly 94 mounted between the side plates 64, 66 of the frame 62. The guide assembly 94 comprises an upper guide subassembly 96 and a lower guide subassembly 98. The upper guide subassembly 96 includes an outer guide 100 and an inner guide 102. The material 12 is illustrated in FIG. 3 traveling through the upper guide subassembly 96 without contacting the outer and inner guides 100, 102 for the sake of clarity. However, in operation of the accumulator assembly 60 the material 12 will be in sliding contact with the outer and inner guides 100, 102, as well as the lower guide subassembly 98.

The outer and inner guides 100, 102 can be constructed of any suitable material. However, it is preferable that the outer and inner guides 100, 102 be constructed of a plurality of parallel, spatially disposed relatively thin guide rods 104 interconnected by a plurality of cross bars 106 (FIG. 4) in such a manner so as to not impede the material 12 as it travels along the substantially S-shaped travel path defined by the guide assembly 94. That is, the cross bars 106 are positioned perpendicular to the guide rods 104 and attached thereto in a conventional manner, such as by welding or the like; and the outer and inner guides 100, 102 are connected to the side plates 64, 66 in a conventional manner so that the outer and inner guides 100, 102 extend between the side plates 64, 66 substantially as shown.

The outer and inner guides 100, 102 of the upper guide subassembly 96 are each provided with a substantially J-shaped configuration and cooperate to provide a substantially J-shaped slot 108 which defines the travel path for the material 12 through the upper guide subassembly 96. The upper guide subassembly 96 is positioned to receive a material 12 from the pinch roller assembly 80 and direct the material 12 along a linear travel path across an upper portion of the accumulator assembly 60. The upper guide subassembly 96 then directs the material 12 along a 180 degree curved travel path defined by the J-shaped slot 108. Thus, the upper guide subassembly 96 forms the upper loop portion 76A of the substantially S-shaped travel path for the material 12, and thereby guides the material 12 to the lower guide subassembly 98.

The lower guide subassembly 98 includes an inner guide 110, a base guide 112 and a pivotally mounted feed guide 114. The inner guide 110 and the base guide 112 are preferably constructed of a like material and in a like manner as the outer and inner guides 100, 102 of the upper guide subassembly 96. That is, the inner guide 110 and the base guide 112 are constructed of a plurality of guide rods spaced apart in a parallel relationship and interconnected with a plurality of cross bars. Furthermore, the inner guide 110 of the lower guide subassembly 98 is of a similar configuration as the inner guide 102 of the upper guide subassembly 96 in that it has a substantially J-shaped configuration which includes a curved portion 116 and a straight portion 118.

The inner guide 110 is positioned between the side plates 64, 66 such that one end of the inner guide 110 of the lower guide subassembly 98 is disposed adjacent one end of the outer guide 100 of the upper guide subassembly 96 substantially as shown in FIG. 3. The inner guide 110 defines the shortest path that the material 12 can travel around the lower loop portion 76B of the substantially S-shaped travel path or line, and thus also defines a downstream end of the accumulator loop area 78.

The base guide 112 has a relatively flat configuration and is positioned below the straight portion 118 of the inner guide 110 such that the base guide 112 runs parallel to the straight portion 118 of the inner guide 110 and cooperates with the straight portion 118 to form a slot 120 that defines an exit end portion of the substantially S-shaped travel path for the material 12. The base guide 112 further extends across the entire length of the frame 62 so as to provide a base support for the accumulator loop in the accumulator loop area 78.

The feed guide 114 of the lower guide subassembly 98, which facilitates feeding the material 12 through the lower guide subassembly 98, comprises a pair of arcuate shaped first guide rod members 122 pivotally connected to the: side plates 64, 66 so as to be disposed in a parallel, spatially disposed relationship with one another. The pivotal connection of the first guide rod members 122 to the side plates 64, 66 permits the first guide rod members 122 to be selectively movable between a first or lowered position (shown in phantom lines in FIG. 3), and a second or raised position (shown in bold lines in FIG. 3). In the lowered position the accurate configuration of the first guide rod members 122 permits the first guide rod members 122 to be disposed parallel to the curved portion 116 of the inner guide 110. Thus, in the lowered position the first guide rod members 122 function as an outer guide to guide the material 12 around the curved portion 116 of the inner guide 110 and into the slot 120 formed between the inner guide 110 and the base guide 112. However, when the processing equipment is in operation and the material 12 is passing through the accumulator assembly 60, the first guide rod members 122 of the feed guide 114 are locked in a raised position. Thus, the outer guide formed by the feed guide 114 is removed, thereby allowing the lower loop portion 76B of the material 12 to move back and forth along the accumulator loop area 78 in response to the material demands of the processing equipment.

To permit an operator to selectively rotate the first guide rod members 122 of the feed guide 114 between the raised position and a lowered position from the exterior side of the frame 62, a handle 126 is connected to one end of a rod member 128 employed to pivotally connect the first guide rod members 122 to the side plates 64, 66 of the accumulator assembly 60. One of the side plates (shown herein as side plate 66) is provided with a pair of holes (not shown) that are adapted to receive an indexing pin 130 supported by the handle 126. The holes (not shown) are located in the side plate 66 such that the first guide rod members 122 of the feed guide 114 can be locked in either the raised or lowered position by the indexing pin 130.

The feed guide 114 of the lower guide subassembly 98 further comprises a pair of arcuately shaped second guide rod members 132 connected to one of the cross members 68 via an extension or leg member 134 so that the second guide rod members 132 are disposed in a parallel, spatially disposed relationship with one another at an upstream end 136 of the accumulator assembly 60. Thus, the second guide rod members 132 function to define one end portion of the lower loop portion 76B of the accumulator loop of material 12 as the material 12 travels through the accumulator loop area 78.

The downstream processing equipment can consist of large progression processes or can be material feed rate intensive processes, thus resulting in the material demand requirements of the processing equipment changing continuously. Also, the pay out rate of the uncoiling assembly 10 will vary as the coil 13 pays out material 12; that is, as the diameter of the coil 13 decreases, the rate at which material is paid out from the coil 13 also decreases. To maintain a steady-state supply of material 12 for the processing equipment, it is desirable that the accumulator assembly 60 be able to detect changes in the material demand of the processing equipment and the pay out of the uncoiling assembly 10, and in turn, signal the uncoiling assembly 10 to make the required pay out rate adjustments.

To provide a steady-state supply of the material 12 to downstream processing equipment without placing undesired tension on the material 12, the uncoiling assembly 10 is provided with a feed rate control circuit 137 (FIG. 5) that detects the extent of the loop 76 of the material 12 in the accumulator loop area 78 and adjusts the speed of the motor 86 that drives the lower roller 82 to maintain the length of the loop 76 between the maximum and minimum set points in a manner to be discussed hereinafter.

To this end, the control circuit 137 comprises a plurality of set point detectors, each of which is provided with a light emitter that projects a beam of light across the accumulator loop area 78 and a receiver that receives the beam, (unless it is blocked by the loop 76), to provide indications of the length of the loop 76 with respect to the set points. More specifically, the control circuit 137 comprises a high or maximum set point receiver 138 (FIG. 3) that receives a beam of light from a high set point emitter 140, and a low or minimum set point receiver 142 that receives a beam of light from a low set point emitter 144. A suitable construction for the high and low set point receivers 138, 142, is a combination of a photocell and solid state relay connected between the control circuit power supply (not shown) to provide a voltage level that is substantially equal to the control circuit power supply voltage in response to reception of light from an emitter and to provide substantially a power supply ground voltage when a receiver is blocked by the loop 76 of material 12.

As shown in FIG. 3, the high and low set point emitters 140, 144, are supported above the accumulator loop area 78 by a support rod 146; and the high and low set point receivers 138, 142 are supported below the accumulator loop area 78 by a support 148 so as to be aligned with the high and low set point emitters 140, 144, respectively. Thus, the high and low set point emitters 140, 144 and the high and low set point receivers 138, 142 are positioned on the accumulator assembly 60 to define desired maximum and minimum lengths for the loop 76 within the accumulator loop area 78. Additionally, it is contemplated that a no-loop condition may occur and, as will be discussed hereinafter, the control circuit 137 responds to the absence of the loop 76 in the accumulator loop area 78 by terminating operation of the uncoiling assembly 10 and the downstream processing equipment. Thus, the control circuit 137 further comprises a no-loop emitter 150 and a no-loop receiver 152 (also sometimes referred to herein as a no-line emitter and a no-line receiver, respectively) positioned in close proximity to the end portion of the accumulator assembly 60 from which the loop of the material 12 is formed. Remaining portions of the control circuit 137 and the operation thereof will be described in more detail hereinafter.

To ensure that the material 12 is centered as it travels through the accumulator loop area 78, the accumulator assembly 60 further includes a pair of guide plates 154. Each of the guide plates 154 is configured to extend from the inner guide 110 of the lower guide subassembly 98 to the upstream end 136 of the accumulator loop area 78 which corresponds to the upstream end of frame 62. Further, each of the guide plates 154 is provided with a viewing slot 156 which is aligned with the viewing slots 72 formed in the side plates 64 and 66 when the guide plates 154 are properly positioned between the side plates 64 and 66. The alignment of the viewing slot 156 of one of the guide plates 154 with the viewing slot 72 of the side plate 66 is illustrated in FIG. 3.

The guide plates 154 are mounted along the accumulator loop area 78 in a parallel relationship to the side plates 64, 66 in a manner that enables the material 12 to be centered in the accumulator loop area 78, as well as to provide lateral support to the material 12 as it travels through the accumulator loop area 78. The geometric configuration of the guide plates 154 is such that the guide plates 154 extend along the entire length of the accumulator loop area 78.

As more clearly shown in FIG. 4, each of the guide plates 154 is slidably mounted between the side plates 64 and 66 by bracket assemblies 158, 160 so that the guide plates 154 can be selectively moved in and out to accommodate different widths of material 12. The bracket assemblies 158, which connect the upstream end of each of the guide plates 154 to the frame 62, include a first bracket member 162 and a second bracket member 164. The first bracket member 162 is an L-shaped member secured to the adjacent side plates 64, 66 and is adapted to rotatably receive an adjustment knob 166 which is provided with a screw threaded shaft 168. The second bracket member 164, which is provided with a horizontally oriented slot (not shown), is attached to the guide plates 154. The horizontally oriented slot (not shown) is dimensioned to slidably receive the threaded shaft 168 of the adjustment knob 166. The adjustment knob 166 secures the second bracket member 164 in a selected position when the adjustment knob 166 is tightened and permits the guide plates 154 to be slidably positioned when the adjustment knob 166 is loosened, as described below.

The downstream end of each of the guide plates 154 is supported by one of the bracket assemblies 160. Each of the bracket assemblies 160 includes a bracket member 170 connected to the downstream end of one of the guide plates 154. The bracket members 170 are provided with an opening (not shown) so that the bracket members 170 can slidably move over the rod member 128 of the feed guide 114.

Each of the bracket assemblies 160 further includes a control lever 172 that permits an operator to slidably position the guide plates 154. The control lever 172 is rigidly attached to each of the guide plates 154 such that the control lever 172 extends outwardly therefrom. An opening (not shown) is disposed in the adjacent side plate 64, 66 through which the control lever 172 is slidably disposed. Thus, the guide plates 154 can be selectively positioned by pushing or pulling the control lever 172 until the desired position of the guide plates 154 is achieved. To facilitate the positioning of the guide plates 154, the control lever 172 is provided with a handle portion 174 substantially as shown in FIG. 3.

To secure the guide plates 154 in a stable position, the control lever 172 extends through a box-like support bracket 180 mounted on the exterior of the side plates 64, 66. The support bracket 180 functions to support the control lever 172 and an adjustment knob 182. The adjustment knob 182 has a threaded shaft 184 (FIG. 3) matable with internal threads in the support bracket 180 which allows the end of the threaded shaft 184 to selectively engage the control lever 172 and thereby secure the guide plates 154 in the desired position.

In the operation of the accumulator assembly 60, the material 12 is fed between the lower and upper rollers 82, 84 of the pinch roller assembly 80 by raising the upper roller 84 with the hand lever 85. After the material 12 has been fed between the lower and upper rollers 82, 84, the upper roller 84 is lowered so that the lower and upper rollers 82, 84 engage the material 12 positioned therebetween. The material 12 is then fed into the guide assembly 94 by jogging the pinch roller assembly 80. While the material 12 is fed through the guide assembly 94, the feed guide 114 of the lower guide subassembly 98 is secured in the lowered position by the indexing pin 130. Thus, the material 12 is directed to the processing equipment via the travel path defined by the upper guide subassembly 96 and the lower guide subassembly 98. When the material 12 has been fed through the guide assembly 94, the feed guide 114 is moved to its raised position and secured by the indexing pin 130.

With the material 12 fed through the accumulator assembly 60 and the feed guide 114 secured in the raised position, the pinch roller assembly 80 is again jogged until an accumulator loop 76 of the material 12 is formed in the accumulator loop area 78 of the accumulator assembly 60. The material 12 is then centered in the accumulator loop area 78 with the guide plates 154.

Figure 5:
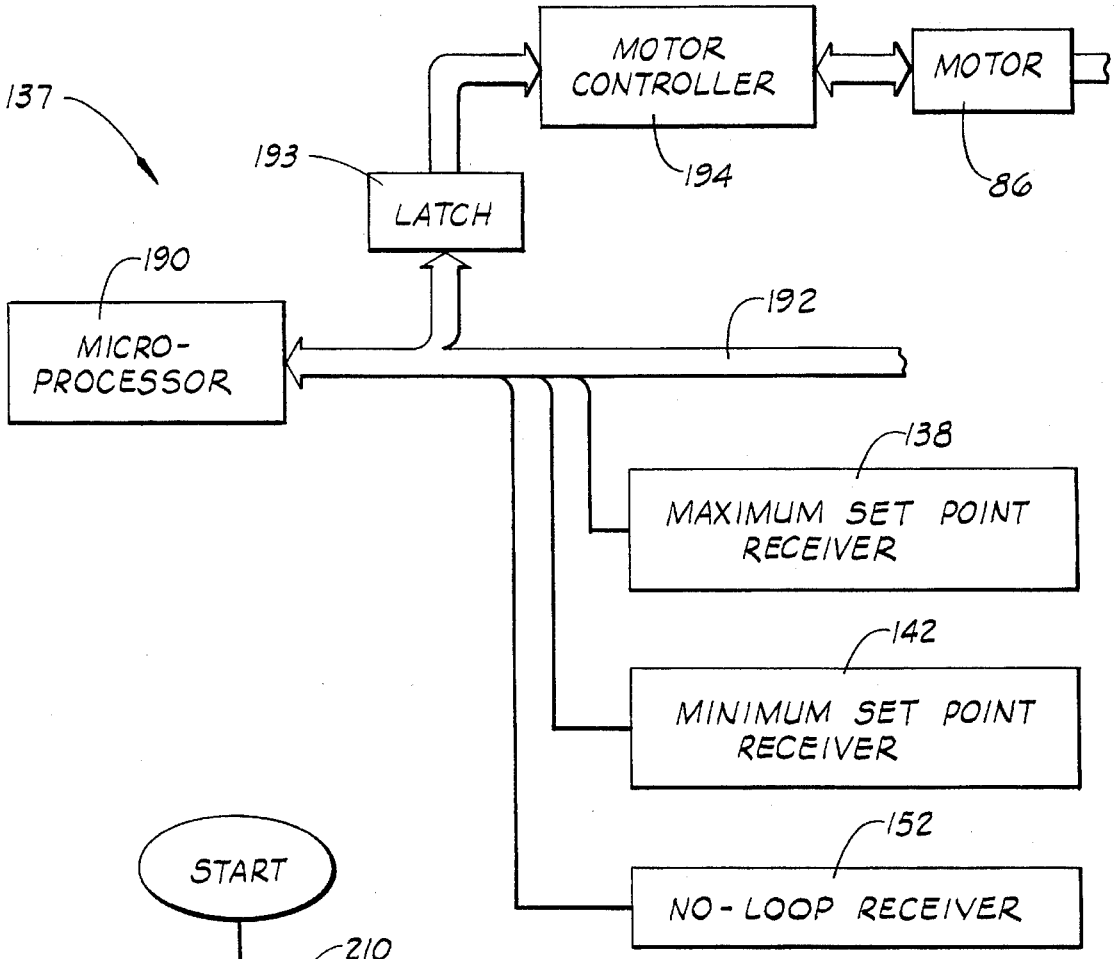
FIG. 5 is a block diagram of a control circuit for maintaining the length of a line or loop of material within preselected limits in the feed stock accumulator assembly of FIG. 1.

Referring now to FIG. 5, the control circuit 137 comprises a microprocessor 190 which periodically polls the outputs of the high set point receiver 138, the low set point receiver 142 and the no-loop receiver 152 to determine whether the loop 76 has been formed within the accumulator assembly 60 and, if so, the extent Of the length of the loop portion 76B with respect to the high and low set points determined by the placement of the high and low set point receivers 138, 142 and the high and low set point emitters 140, 144 on the accumulator assembly 60. To this end, the high set point receiver 138, the low set point receiver 142 and the no-loop receiver 152 are connected to a data bus 192 of the microprocessor 190, and the microprocessor 190 provides appropriate signals to the high set point receiver 138, the low set point receiver 142 and the no-loop receiver 152 to read such outputs in a conventional manner.

During normal operation of the control circuit 137 the microprocessor 190 repetitively executes a control program, to be discussed hereinafter, in which the microprocessor 190 determines the length of the loop portion 76B with respect to the high and low set points selected by the placement of the high and low set point emitters 140, 144 and the high and low set point receivers 138, 142 on the accumulator assembly 60. In response thereto, the microprocessor 190 outputs a digitally expressed feed signal to a latch 193 which provides the feed rate to a conventional motor controller 194 that controls the speed of the motor 86 driving the lower roller 82 of the pinch roller assembly 80. Accordingly, by adjusting the feed rate of the material 12 which forms the accumulator loop 76 within the accumulator assembly 60, the control circuit 137 can maintain the length of the loop portion 76B between the high and low set points while the material 12 is drawn from the loop 76 by the downstream processing equipment.

Flow charts for one cycle of the control program for the microprocessor 190 are illustrated in FIGS. 6 through 9, to which attention is now invited. Referring first to FIG. 6, the outputs of the high, low and no-loop receivers 138, 142 and 152, respectively, are input step 196, at the beginning of each control cycle and an initial check is made, step 198, to determine whether the loop 76 of material 12 is present in the accumulator assembly 60. As will be clear from the above description of the control circuit 137, the presence of the loop portion 76B will be indicated by an output of the no-loop receiver 152 indicating that the light beam from the no-loop emitter 150 is blocked. Should a no-loop condition be detected, the control program enters a shut down routine 199 in which both the uncoiling of the material 12 and the processing of the material 12 by downstream processing equipment is terminated. Such termination can be effected in a conventional manner by opening power relays (not shown) through which electrical power is supplied to the uncoiling assembly 10 and the downstream processing equipment.

If the loop 76 of the material 12 is present in the accumulator loop area 78, the microprocessor 190 executes remaining portions of the control program to control feeding of the material 12 into the accumulator loop area 78 at a rate that will maintain the loop portion 76B and thereby provide a steady supply of the material 12 to the downstream processing equipment. In the first step of this "normal operation" portion of the program, step 200, the microprocessor 190 determines whether the loop portion 76B extends to the low or minimum set point, a condition that will be indicated by an output of the low set point receiver 142, that, in turn, indicates that the loop portion 76B has intercepted the beam of light between the low set point emitter 144 and the low set point receiver 142. If the loop portion 76B does not extend to the low set point, a high speed routine 202 is executed to increase the feed rate of the material 12 into the accumulator loop area 78 (as will be discussed hereinafter with reference to FIG. 9), and the program returns to the input of receiver output states to execute the next control cycle.

If the loop portion 76B extends beyond the low set point, a check is then made, step 204, to determine whether the loop portion 76B extends beyond the high set point, a condition indicated by an output of the high set point receiver 138 that the loop portion 76B has blocked the beam of light between the high set point emitter 140 and the high set point receiver 138. If the loop portion 76B extends beyond the high set point, a low speed routine 206 is executed to decrease the feed rate of the material 12 into the accumulator loop area 78 (as will be discussed hereinafter with reference to FIG. 8), and the program returns to the input of receiver output states to execute the next control cycle. If the extent of the loop portion 76B is between the low and high set points, a base speed routine 208 is executed and followed by a return to input of receiver states for the next control cycle.

Figure 7:
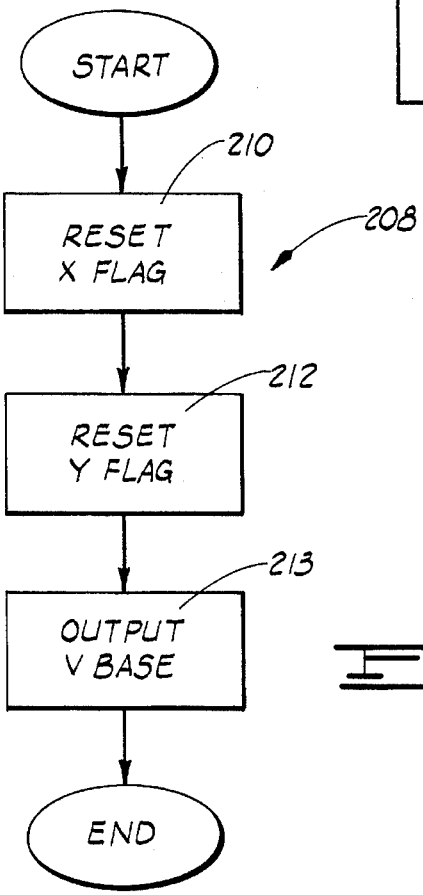
FIG. 7 is a flow chart of the base speed routine of the control circuit of FIG. 5.
Figure 5:
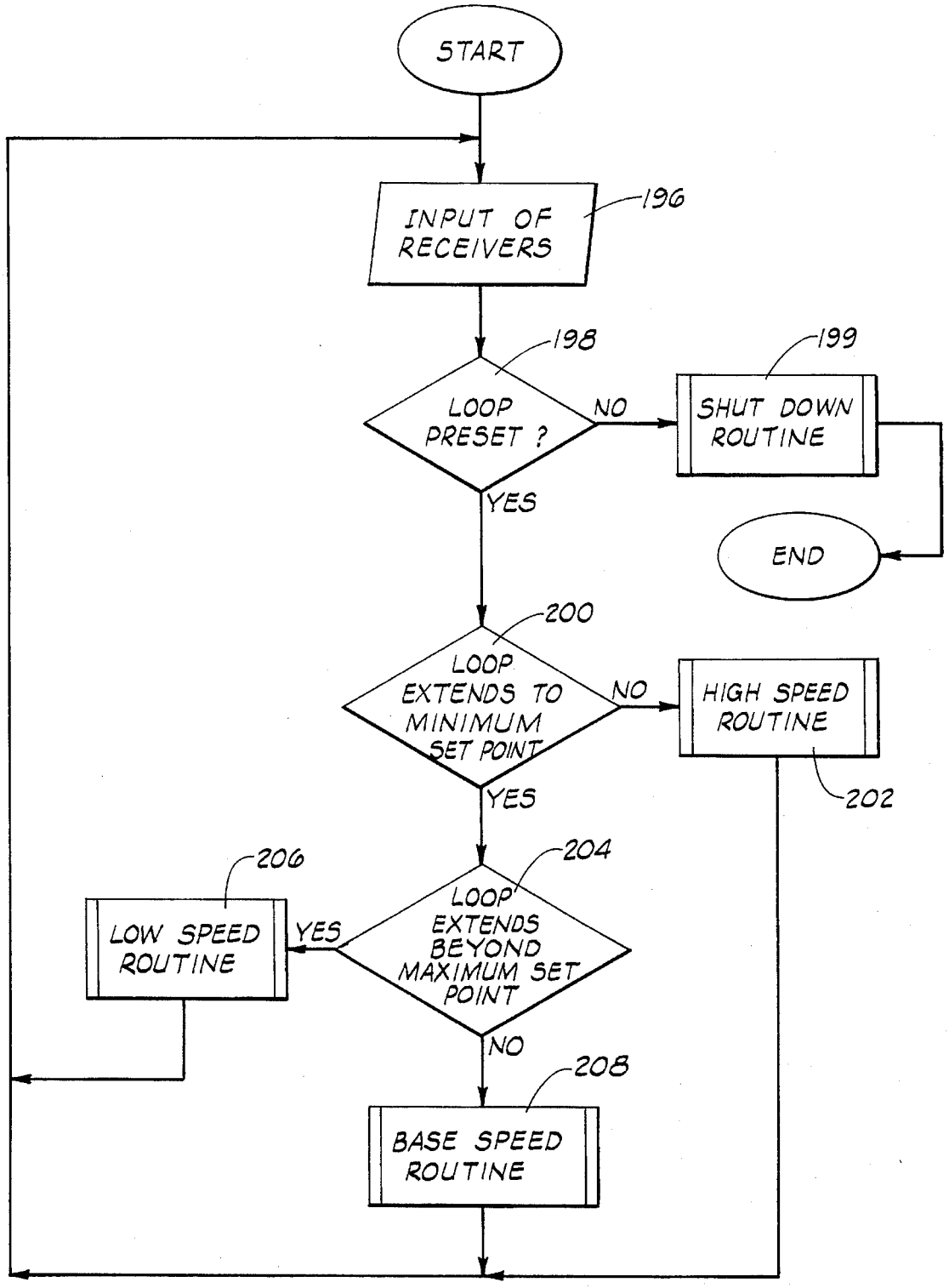

Referring now to FIG. 7, shown therein is a flow chart of the base speed routine 208. In the execution of the base speed routine 208, X and Y flags whose purpose will be described below are reset, steps 210 and 212, and the microprocessor 190 outputs a stored base velocity to the latch 193, step 212, and the routine ends. As will be discussed below, the base velocity is adjusted each time the length of the loop portion 76B increases or decreases to cause the extent of the loop portion 76B to undergo an excursion from between the low and high set points and the adjusted value is stored for use during subsequent executions of the base speed routine 208.

Should the rate at which the material 12 is fed to the accumulator loop area 78 by the pinch roller assembly 80 exceed the rate at which the material 12 is withdrawn from the accumulator loop area 78 by the downstream processing equipment, the length of the loop portion 76B will increase so that, eventually, the loop portion 76B will extend beyond the high set point within the accumulator loop area 78. Thus, in the ensuing control cycle, the low speed routine 206 will be executed.

Figure 8:
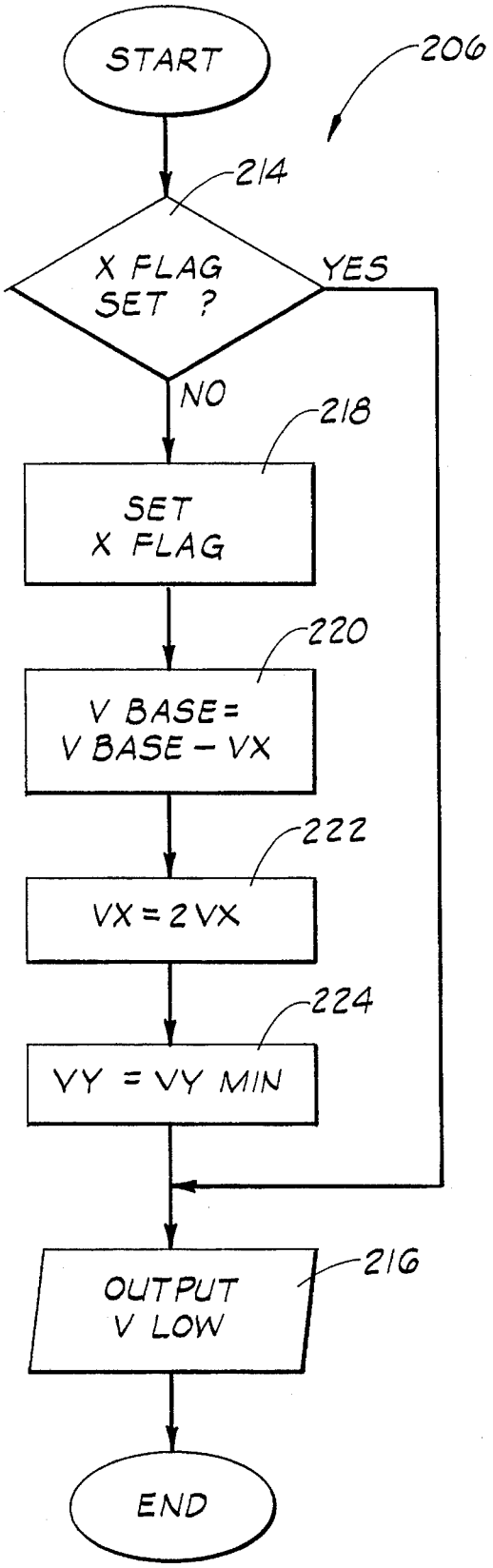
FIG. 8 is a flow chart of the high speed routine of the control circuit of FIG. 5.

Referring now to FIG. 8, the low speed routine 206 begins with a check of the aforementioned X flag, step 214. If the X flag is set, the program jumps to an output step, step 216, with which the low speed routine 206 terminates. In step 216 the microprocessor 190 outputs to the latch 193, a motor speed value that has been preselected to cause the motor 86 to drive the lower roller 82 of the pinch roller assembly 80 at a speed that will result in a feed rate of the material 12 into the accumulator loop area 78 that is less than the minimum rate at which the material 12 can be drawn into the downstream processing equipment. Accordingly, the material 12 will be fed from the loop accumulator loop area 78 at a rate that exceeds the rate at which the motor 86 and the pinch roller assembly 80 feed the material 12 into the accumulator loop area 78 so that the length of the loop portion 76B will begin to decrease. Since the low speed routine 206 terminates with the output of the low speed value, the decrease in the length of the loop portion 76B must continue so long as the loop portion 76B extends beyond the high set point so that the loop portion 76B must eventually decrease to extend between the low and high set points.

However, merely returning the loop portion 76B to the desired extension within the accumulator loop area 78, with nothing more, will generally lead to an ensuing excursion of the loop portion 76B beyond the high set point. The reason for this is that such loop excursion is caused by feeding material 12 into the accumulator loop area 78 using a motor base speed that causes the feed rate of the material 12 to exceed the rate at which the material 12 is withdrawn by the downstream processing equipment.

Accordingly, in the first control cycle following the excursion of the loop portion 76B from between the set points, the base speed is decremented to lower the feed rate of the material 12 into the accumulator loop area 78 when the loop portion 76B again extends between the low and high set points. It is for this purpose that the X flag is reset at step 210 of the base speed routine 208 shown in FIG. 7. When the excursion occurs, the X flag will be reset so that the check made in step 214 of FIG. 8 will yield a negative result. In response, the microprocessor 190 will initially set the X flag (step 218) and then decrement the base speed by an X decrement (VX); a second excursion of the loop portion 76B beyond the high or maximum set point will occur, and the low speed routine will again be executed in a series of control cycles following detection of the excursion. Since the X flag has been reset, by the return of the loop extension to the control region between the set points, the base speed will again be decremented in the first control cycle that occurs in which the excursion is detected. However, in this second excursion, the decrement of the base speed will be twice that of the first excursion to provide a greater likelihood that the base speed will have a sufficiently low value that further excursions of the loop 76B beyond the high set point will not occur after the excursion has been corrected. Since the decrement VX is doubled each time an excursion occurs, the base speed will be quickly brought to a value that will prevent further excursions of the loop beyond the high set point.

Figure 9:
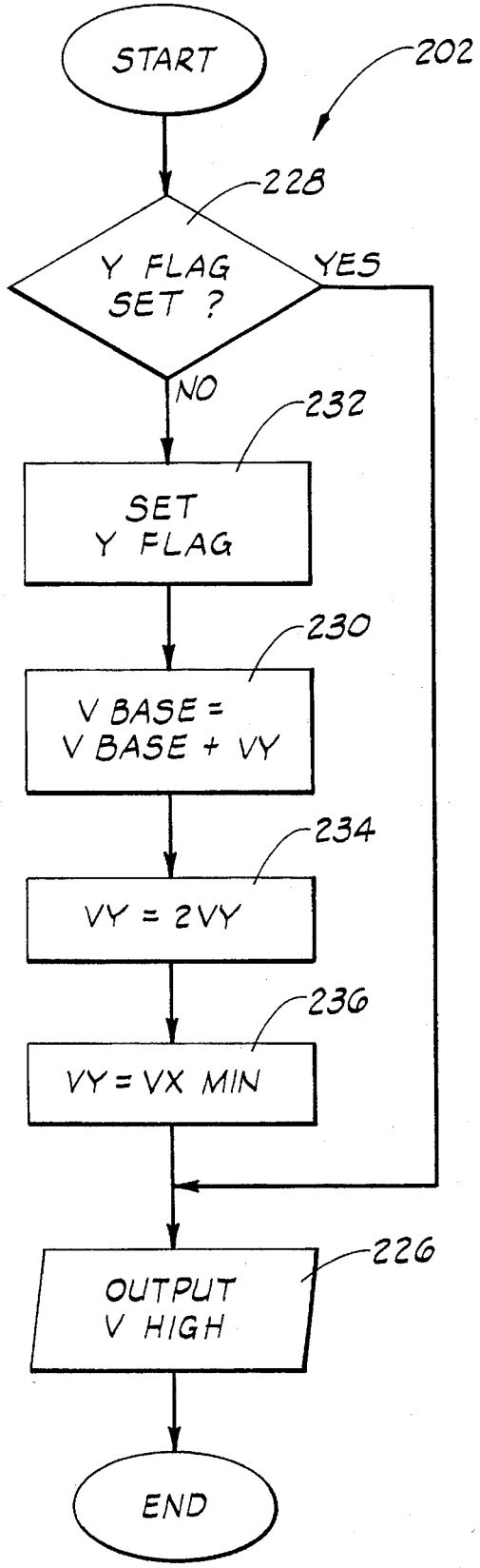
FIG. 9 is a flow chart of the low speed routine of the control circuit of FIG. 5.

The high speed routine 202, illustrated by the flow chart in FIG. 9, similarly corrects excursions of the loop from between the set points caused by the withdrawal of material 12 from the accumulator loop area 78 by the downstream processing equipment at a rate greater than the rate at which the material 12 is fed into the accumulator assembly 60. To this end, each excursion of the high speed routine terminates with the output (step 226) to the latch 193 and the motor controller 194 of a high speed value that will cause the motor 86 to feed the material 12 at a rate that exceeds the maximum rate at which the downstream processing equipment can withdraw the material 12 from the accumulator loop area 78. Excursions of this type are corrected in similar fashion to that of excursion correction described hereinabove. Thus, for each loop excursion, the resetting of the Y flag during the previous execution of the base speed routine 208, checked at step 228, will result in incrementing of the base velocity, step 230, after setting the Y flag, step 232, by a Y increment VY. The Y increment is then doubled, step 234, to rapidly bring the base velocity to a value that will tend to maintain the loop portion 76B between the set points in the same fashion that the X decrement is doubled in the first execution of the low speed routine 206. The X decrement is then set to the preselected minimum value during the first execution of a low speed routine as hereinbefore described.

The setting of the X decrement and the Y increment to the minimum value when the high speed and low speed routines 202, 206, respectively, are first executed in response to an excursion of the loop portion 76B from between the set points ensures that neither the X decrement, or the Y increment, will build up indefinitely to cause the loop portion 76B to cycle indefinitely between the two types of excursions, while still permitting the rapid adjustment of the base speed that doubling the X decrement, or the Y increment, affords. In particular, should the X decrement for the low speed routine 206 cause the base speed to fall to a value that is insufficient to maintain the loop portion 76B within the region between the set points, an excursion of the loop portion 76B requiring an increase in the base speed in such excursion will be the minimum increment to cause only a fine adjustment of the base speed. Thus, should either excursion from the region between the set points occur, the base speed must eventually be adjusted to a value that will maintain the extent of the loop portion 76B between the set points.

For industrial applications other than for that described hereinabove, where the material inventoried as the material 12 is in the form of a continuous strip or web, the present invention will find utility in all such applications where the material, either in continuous or incremental form (such as beverage cans fed in a linear path), can be constrained in an accumulator area so that either a loop of such material, as described herein for the strip material 12, or a line of discrete but continuous articles will be caused to travel in a preselected path or line. The extent of such material along such line can be detected by the high and flow set point emitters and receivers (such as at 140, 144 and 138, 142 described above) and a no-line emitter and no-line receiver (such as at 150, 152 described above). Once the material travel path is established, the amount of material in the accumulator area can be monitored in the manner described hereinabove for providing a continuous source of the material to downstream processing equipment in accordance with the present invention.

From the above description it is clear that the present invention is well adapted to carry out the objects and to attain the ends and advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A system for regulating the feed rate of a feed stock and for providing a supply of the feed stock to processing equipment, the system comprising:

accumulator means having an accumulator line area;

feed means for feeding feed stock into the accumulator line area to form a line of feed stock; and control means for detecting the presence or absence of the feed stock line at set points in the accumulator line area and for controlling the feed rate of the feed means so that the feed stock line in the accumulator line area is maintained between a preselected minimum and a preselected maximum and to thereby provide a constant supply of the feed stock for the processing equipment, the control means comprising:

a pair of set point detectors for detecting the presence or absence of the feed stock line at the set points in the accumulator line area; and means for adjusting the rate at which the feed means delivers the feed stock into the accumulator line area at a base feed rate determined in response to the detected extent of the feed stock line in the accumulator line area so that the length of the feed stock line is maintained between the pair of set point detectors so that the feed stock line is maintained between the preselected minimum and maximum in the accumulator area, the base feed rate increasingly adjusted to a higher value or to a lower value in each of a series of successive excursions of the feed stock line from between the preselected minimum in the accumulator area.

2. The system of claim 1 wherein the control means comprises:

a third set point detector for detecting the presence or absence of the feed stock line in the accumulator area.

3. The system of claim 2 wherein the accumulator means defines a travel path for the feed stock line through the accumulator line area, and wherein each of the set point detectors comprises a light emitter and a receiver, the light emitter adapted to project a beam of light across the accumulator line area to an associated receiver so as to indicate the presence or absence of the feed stock line at each set point detector.

4. A system for regulating the feed rate of material and for providing a supply of tension-free strip material which can be drawn into downstream processing equipment, the system comprising:

uncoiling means for supporting at least one coil of strip material;

accumulator means for accumulating strip material from the coil and having an accumulator loop area, the accumulator means forming a strip material loop extending into the accumulator loop area and comprising:

feed means for feeding strip material and forming a continuous material loop extensive into the accumulator loop area; and control means for detecting the presence or absence of the material loop at set points in the accumulator loop area and for controlling the feed rate of the feed means so that the material loop is maintained between a preselected minimum length and a preselected maximum length, the control means comprising:

a plurality of set point detectors at the set points for detecting the presence or absence of the material loop between the set point detectors; and means for adjusting the rate from a base feed rate at which the feed means extends the length of the material loop into the accumulator loop area in response to the presence or absence of the material loop between the set point detectors so that the material loop is maintained between the set point detectors, the base feed rate increasingly adjusted to a higher or lower value in each of a series of successive excursions of the material loop from between set point detectors.

5. The system of claim 4 wherein the accumulator means defines a substantially S-shaped travel path for the material through the accumulation loop area, and wherein each of the set point detectors comprises a light emitter and a receiver, the light emitter adapted to project a beam of light across the accumulator loop area to its associated receiver so as to signal the presence of the material loop therebetween.

6. The system of claim 5 wherein the feed means is a coil assembly feeding coil feed stock and comprises:

a pinch roller assembly;

a variable speed motor for powering the pinch roller assembly; and means for controlling the variable speed motor responsive to signals from the set point detectors.

7. A method for regulating the feed rate of a feed stock from a coil assembly to processing equipment, the method comprising:

forming a loop of the feed stock between the coil assembly and the processing equipment;

detecting the presence or absence of the loop between set point detectors to determine whether the length of the strip material loop is less than a preselected minimum length, greater than a preselected maximum length or between the minimum and maximum lengths;

feeding the feed stock to the loop at a preselected high feed rate greater than the rate at which the feed stock is drawn by the processing equipment at such times that the loop is less than the preselected minimum length;

feeding the feed stock to the loop at a preselected low feed rate lower than the rate at which the feed stock is drawn by the processing equipment at such times that the loop is greater than the preselected maximum length;

feeding the feed stock to the loop at a base feed rate between the preselected high feed rate and the preselected low feed rate at such times that the loop is between the preselected minimum and maximum lengths;

adjusting the base feed rate to a lower value each time the loop has a length greater than the preselected maximum length; and adjusting the base feed rate to a higher value each time the loop has a length less than the preselected minimum length, and wherein the increase in the base feed rate in each of a series of successive excursions of the length of the loop from between the preselected minimum and maximum lengths to a length less than the preselected minimum length is increased for each successive excursion, and wherein the decrease in the base feed rate in each of a series of successive excursions of the length of the loop from between the preselected minimum and maximum lengths to a length greater than the preselected maximum length is increased for each successive excursion.

8. The method of claim 7 further comprising:

stopping the feeding of the feed stock when the detecting step detects the absence of the loop between all of the set point detectors.

* * * * *

UNITED STATES PATENT AND TRADEMARK OFFICE

CERTIFICATE OF CORRECTION

PATENT NO. : 5,622,330

DATED : April 22, 1997

INVENTOR(S) : Roger F. Sharp, Terry M. Frost, and Don W. Graham

It is certified that error appears in the above-indentified patent and that said Letters Patent is hereby corrected as shown below:

Column 1, line 33, delete the first word of the line "rams", and insert --rates--.

Column 7, line 10, after the word "the", delete the colon ":".

Column 10, line 21, delete "Of" and insert --of--.

Column 14, line 1, after the word "maintained" and before the word "between", insert the words --to extend--.

Signed and Sealed this

Twenty-first Day of October 1997

*Attest:*

Bruce Lehman

BRUCE LEHMAN

*Attesting Officer*

*Commissioner of Patents and Trademarks*